US007271790B2

(12) United States Patent
Hudson et al.

(10) Patent No.: US 7,271,790 B2
(45) **Date of Patent: *Sep. 18, 2007**

(54) COMBINED TEMPERATURE AND COLOR-TEMPERATURE CONTROL AND COMPENSATION METHOD FOR MICRODISPLAY SYSTEMS

(75) Inventors: Edwin Lyle Hudson, Los Altos, CA (US); David Charles McDonald, Longmont, CO (US)

(73) Assignee: eLCOS Microdisplay Technology, Inc., Sunnyvale, CA (US)

( * ) Notice: Subject to any disclaimer, the term of this patent is extended or adjusted under 35 U.S.C. 154(b) by 361 days.

This patent is subject to a terminal disclaimer.

(21) Appl. No.: 10/682,498

(22) Filed: Oct. 9, 2003

(65) Prior Publication Data

US 2004/0070562 A1 Apr. 15, 2004

Related U.S. Application Data

(60) Provisional application No. 60/417,786, filed on Oct. 11, 2002.

(51) Int. Cl.
*G09G 3/36* (2006.01)

(52) U.S. Cl. ..... 345/88; 345/101

(58) Field of Classification Search ..... 345/101, 345/88, 87

See application file for complete search history.

(56) References Cited

U.S. PATENT DOCUMENTS 3,936,817 A * 2/1976 Levy et al. ..... 345/214
5,926,162 A * 7/1999 Wood et al. ..... 345/101
5,936,603 A * 8/1999 Lippmann et al. ..... 345/101
5,936,604 A * 8/1999 Endou ..... 345/101
6,744,415 B2 * 6/2004 Waterman et al. ..... 345/87
6,806,871 B1 * 10/2004 Yasue ..... 345/211
6,862,012 B1 * 3/2005 Funakoshi et al. ..... 345/88
2002/0158825 A1 * 10/2002 Endo et al. ..... 345/87

OTHER PUBLICATIONS

Authors: Slavko Amon, Danilo Vrtacnik, Drago Resnik, Dejan Krizaj, Uros Aljancic, Matej Mozek Title: PTAT Sensors Based on SJFETs 10th Mediterranean Electrotechnical Conference, MEleCon 2000, vol. II pp. 802-805.*

* cited by examiner

*Primary Examiner*—Amr A. Awad
*Assistant Examiner*—Tom V Sheng
(74) *Attorney, Agent, or Firm*—Bo-In Lin

(57) ABSTRACT

A temperature control and compensation system is implemented by employing a closely coupled electrical architecture that applies the measured microdisplay temperature, one for each color channel, together with lookup tables preloaded with measured or predicted data for a display, to modify the liquid crystal voltage operating range of each microdisplay as required to achieve and maintain the proper white point operating point for the display. The electrical architecture includes functional blocks as required for realizing the temperature compensation and control for each color channel. The system microprocessor and control unit employs a lookup table to set the control registers on each microdisplay controller with values according to a computed value using the data retrieved from the lookup tables. The range of values in the lookup table includes setups for a number of varied conditions. One of these conditions is temperature.

27 Claims, 13 Drawing Sheets

| Panel Temperature (C) | Normalized Panel Efficiency (%) | Drive Voltages | | | |
|---|---|---|---|---|---|
| | | $V_{WHITE}$ | $V_{BLACK}$ | $V_{ITO1}$ | $V_{ITO2}$ |
| 65 | 90 | $V_{WH65-4}$ | $V_{BL65}$ | $V_{ITO1-65}$ | $V_{ITO2-65-4}$ |
| | 80 | $V_{WH65-3}$ | | | $V_{ITO2-65-3}$ |
| | 70 | $V_{WH65-2}$ | | | $V_{ITO2-65-2}$ |
| | 60 | $V_{WH65-1}$ | | | $V_{ITO2-65-1}$ |
| 60 | 90 | $V_{WH60-4}$ | $V_{BL60}$ | $V_{ITO1-60}$ | $V_{ITO2-60-4}$ |
| | 80 | $V_{WH60-3}$ | | | $V_{ITO2-60-3}$ |
| | 70 | $V_{WH60-2}$ | | | $V_{ITO2-60-2}$ |
| | 60 | $V_{WH60-1}$ | | | $V_{ITO2-60-1}$ |
| 55 | 90 | $V_{WH55-4}$ | $V_{BL55}$ | $V_{ITO1-55}$ | $V_{ITO2-55-4}$ |
| | 80 | $V_{WH55-3}$ | | | $V_{ITO2-55-3}$ |
| | 70 | $V_{WH55-2}$ | | | $V_{ITO2-55-2}$ |
| | 60 | $V_{WH55-1}$ | | | $V_{ITO2-55-1}$ |
| … etc | … etc | … etc | … etc | … etc | … etc |

Fig. 6A

COMBINED TEMPERATURE AND COLOR-TEMPERATURE CONTROL AND COMPENSATION METHOD FOR MICRODISPLAY SYSTEMS

This Application is a Continuation-in-Part (CIP) Application and claim a Priority Date of Oct. 11, 2002 benefited from a Provisional Patent Application 60/417,786 file by one common inventor of this patent application.

BACKGROUND OF THE INVENTION

1. Field of the Invention

The present invention pertains to liquid crystal on silicon (LCOS) displays, and more particularly to improved temperature and color temperature control and compensation method for the microdisplay systems.

2. Description of the Prior Art

Since microdislay systems, especially the liquid crystal on silicon (LCOS) Microdisplay frequently operate in the hot interior of a projection device, the microdisplay technology is still challenged by the need to effectively control the temperature and compensate for the color balancing under the circumstances of temperature increase such that the quality of display would not be impaired by uncontrolled high temperatures. The difficulties of color balancing are compounded because the display from each color element has its own individual temperature variations and each color element also has different temperature sensitivities. Meanwhile, it is imperative to control and proper compensate the color balancing operated under temperature variations because the color balance of a projection system is an important feature of its performance.

In a well-designed system, the color balance is determined by the respective power levels of the primary colors and by the spectral bandwidths of those colors. Various techniques have long been known in the art that can be used to achieve color balance in a projection display system where the intensities of the three colors can be modulated separately. In the application of such techniques to projection systems based on microdisplays and spatial light modulator, some problems arise. First, the microdisplays most often operate in the hot interior of a projection device. As will be further discussed below, all components within such devices have thermal sensitivities of some sort. The birefringence of the liquid crystal material within such a display normally becomes lower with elevated temperature and thus the electro-optical (EO) curve for such a device is highly temperature dependent. In a system using three separate microdisplays the situation often arises where each of the microdisplays operates at a different temperature than the others. When the unit is first turned on after having previously reached ambient temperature the microdisplays are all operating at lower than normal temperature. While the rise in temperature begins immediately it may take 30 minutes to reach a new, stable set of operating temperatures. The voltage transfer curve has been shown to vary with temperature. Additionally, the voltage-transfer curves for each color device at a given temperature differ because of the differences in the materials. A technical challenge is faced by the microdisplay system to provide a method of determining the temperature of the liquid crystal to develop and implement control methods that mitigate the effects of high or low temperature through temperature control or other compensation and that simultaneously maintain proper color balance.

There are several prior art approaches taken in attempt to solve the problems caused by temperature variations in a microdisplay system including disclosures made by 1) U.S. Pat. No. 6,304,243, Kondo, et al, "Light Valve Device" Oct. 16, 2001, column 28, line 62 through column 29, line 37, for a discussion of one approach to the implementation of cooling of a microdisplay; 2) U.S. Pat. No. 4,338,600, Leach, "Liquid Crystal Display System Having Temperature Compensation" Jul. 6, 1982, and 3) U.S. Pat. No. 4,460,247, Hilsum et al, "Temperature Compensated Liquid Crystal Displays", Jul. 17, 1984. Another disclosure was reported by Kurogane et al to use an electro-optic mode that does not exhibit noticeable thermal variation in the linear region of interest. However, the availability of the materials employed and special manufacture processes and mode of operations would significantly restrict the usefulness of the proposed microdisplay systems. Another is the approach taken in U.S. Pat. No. RE 37056, Wortel, et al, where the inventors disclose a method to manufacture the cell in such a manner that the slopes of the electro-optic curves measured at different temperatures in the same liquid crystal device are quite close. A simple temperature measurement system is employed to provide information to a system that can adjust the column drive voltage and thus effect the compensation. However, this particular approach is of limited usefulness because the method requires a very specific approach to the design and manufacture of the cell.

In view of the current state of the art of microdisplay temperature control, there is an ever-increasing demand for new methods and system configurations that can effectively control the temperature and to compensate the performance variations caused by the temperature changes due to the temperature sensitivities of the microdisplay systems. There are several reasons for such increased demand. First, it is observed from operations of microdisplay systems that a liquid crystal experiences a rise in temperature from ambient over a period of 20 to 30 minutes after a system is turned on. This rise in temperature is attributable in part to a rise in ambient temperature within the product case due to heating of the air within by such items as the lamp and by other electronic components. A second major source of heating is the heat generated from the thermal characteristics of the silicon in the LCOS microdisplay itself. A third major source is heat caused by the illumination from the lamp falling on the microdisplay itself. The degree of temperature increase depends on the thermal design of the product and the environment in which it operates. A second reason for the increasing demand to control and compensate temperature effect for a microdisplay system is a observation that the system performance of a microdisplay is strongly temperature dependent. A first sensitivity of LCOS microdisplays is the reduction of the birefringence of the liquid crystal material with elevated temperature within such a display with thus the electro-optic (EO) curve for such a device is highly temperature dependent. One particular aspect of this temperature driven effect is that the dark state rises as temperature deviates from the design temperature and therefore the contrast of such a system suffers.

FIG. 1A shows the strong influence of the temperature changes on the electro-optic performance of a nematic liquid crystal cell constructed by using a 45° twisted nematic (45° TN) in normally black (NB) electro-optic mode. The cell is nominally 5.5 μm thick. The clearing temperature of the liquid crystal is not precisely known but is estimated to be 85° C. Four sample temperature curves determined by experiment are depicted. Thus the major effects of the temperature variations are clear upon inspection. First, the liquid crystal (LC) curve shifts to lower voltage as the temperature of the LC rises. Second, the intensity of the achievable dark state rises as temperature rises. The apparent magnitude of the dark state intensity appears to increase nonlinearly as temperature rises. Third, the location of the peak of the voltage curves shifts to lower voltages as the temperature rises. Fourth, the height of the peak of the voltage curve drops slightly as temperature rises. Finally, the voltage required to achieve the best dark state (whatever that is) does not appear to move significantly with changes in temperature.

Referring to the LC curves of FIGS. 1B and 1C disclosed in U.S. Pat. No. RE 37,056 for further understanding of the temperature dependence of the performance of a microdisplay system. FIG. 1B shows diagrammatically transmission/voltage characteristics of a display device according to the invention at different temperatures, while FIG. 1C shows similar characteristics for a conventional display device. The data as illustrated in FIGS. 1B and 1C are curves for normally white mode transmissive displays which are also representative of reflective mode normally white displays as well. As disclosed in the patent, FIG. 1B presents data that is better behaved than that of FIG. 1C. Implicit in the patent itself in describing the difficulty is the likelihood that the liquid crystal cell is being driven by an analog drive source, such as a Digital-to-Analog Converter (DAC). The DAC would have to be adjusted to a completely different slope and origin in configuring it to drive at different temperature in the case of FIG. 1C. The control and compensation of temperature variation for microdisplay system according to the disclosed techniques would become more cumbersome and inconvenient due to this adjustment requirement.

Thus from the above it is clear that temperature is an important factor in the performance of a liquid crystal device. It is also clear that knowledge of the temperature of a liquid crystal device can enable several commonly known control mechanisms in the electro-optical-mechanical design of a product using such devices. In order to control the microdisplay operational temperature, traditional measures includes the use of fan controlled by a thermostat for activating a fan to increase the air circulation of a microdisplay system. Alternatively the thermostat may be position to measure the heat at a set of heat sinks mounted to the back of the microdisplays. Additionally, the knowledge of several control mechanisms in the electro-optical-mechanical design embodied in different products using such mechanisms can be implemented to further exploit such knowledge to achieve optimal performance. However, as of now, the conventional technologies in microdisplay temperature control still have not fully take advantage of the availability of different control mechanisms to improve and enhance the temperature control and compensation for microdisplay systems operated under widely varying temperatures. Particularly, temperature compensations for adjusting color contrast in response to temperature variations to achieve improved color balancing become more important when the microdisplay systems are subject to greater degree of temperature variations.

Color balance in a system has two important aspects. The first is the range of colors that can be created in a system. This is referred to as the color gamut of the system. It is determined by the spectrum of the color used to create the primary colors of the system. This information is commonly presented as an x-y plot of the color coordinates of the three primaries; the most common system being the CIE 1931 color plots. Colors that can be created by these primaries will have color coordinates that fall within the triangle formed by the three primaries. The x-y coordinates of colors that fall outside the triangle cannot be represented by such colors. The primary colors themselves, in a three-panel projection system, are determined by the spectral characteristics of the lamp, by the various optical filters and the pass characteristics of the optical elements, and by the efficiency and spectral response characteristics of the light modulators. A CIE 1931 plot with indicates of regions associated with particular colors, from page 7 of Hazeltine Corporation Report No. 7128, "Colorimetry", dated Jun. 10, 1952, which in turn cites D. B. Judd, "Color in Business, Science and Industry" John Wiley and Sons, 1952, is shown As FIG. 1D.

The second important aspect of color balance is the color temperature of the white point of the system. In its simplest form the white point of a system is determined by the color coordinates when all three channels are turned on to their maximum intended brightness. This can be measured reliably using instruments such as those used to measure the color coordinates of the primaries. The determination of color temperature requires assessment of the color coordinates against an overlay of the black body curve. A useful version of the curve, presented in FIG. 1F, that shows a chart in CIE 1931 format with the coordinated color temperature and black bodylines. FIG. 1E includes cross lines that indicate the positions of the coordinated color temperature. Coordinates along the line are psychologically considered to be approximately the same color temperature, although they are not exactly the same color.

The color coordinates of the white point of the system are determined not only by the color coordinates of the individual primaries, but by the relative power of the primaries. The relative power of the primaries is normally determined in large part during the design phase when a new projection device is made. It requires a comprehensive assessment of the filtering function of each component within a system, including the microdisplays. FIG. 1F is a sample spectral filtering arrangement showing a typical set of band-pass limits for each color with efficiency superimposed on the normalized lamp spectrum for a high-pressure mercury lamp. In FIG. 1F, the x-axis scale is in the unit of nanometer.

Given a set of performance characteristics, the color coordinates for each spectral channel can be predicted; although it is often preferable to measure the color coordinates experimentally to take into account component variance from the nominal specifications. Similarly, the white point can be predicted from measured data or calculated data, although a direct measurement is a more reliable method. Regardless of the origins of the data, it is clear that changes to the efficiency of the individual color channels will change the relative intensity of portion of the spectrum and therefore will change the color coordinates of the white color point, hence the color temperature of white.

As discussed above, the spectral band-pass limits are normally designed into the system early in its development. While changes can be made, this normally requires the replacement of a spectrally important component, such as a dichroic trim filter or the like. In some cases, dichroic filters are designed and then mounted to facilitate rapid modification of a design.

Furthermore, since the microdisplays are sensitive to variations from the design temperature. In the instances presented, the voltage required to reach maximum efficiency drops as temperature rises. Additionally, it is experimentally proven that the microdisplay for each color may be operating at different liquid crystal temperatures. It is also well known that the curve of voltage versus efficiency is normally different for each color, even in those instances where the liquid crystal cells are identical. This is because the longer wavelengths interact differently with a given cell configuration.

Managing a constant white point under such circumstances is challenging but can be accomplished if the ambient conditions are those predicted by the designers. However, there are always circumstances where the ambient cannot match the exact circumstances predicted. One example is that of a system that has just been turned on and is going through a warm-up period. A second likely circumstance is that the room temperature is hotter or colder than the nominal design temperature for the mechanical design of the system, resulting in the introduction of air into the system that differs from the design expectation to some degree.

For these reasons, there is still need and great challenge in the art of microdisplay such as a three-panel liquid crystal on silicon (LCOS) display to provide improved system architecture and methods of temperature control and color-balancing and compensation to improve the system performance under wide ranges of temperature variations such that the above-mentioned limitations and difficulties can be overcome.

SUMMARY OF THE PRESENT INVENTION

It is therefore an object of the present invention to provide new and improved means to adjust the white point of a liquid crystal on silicon display while that display operates in a temperature regime outside the nominal design point or while that display encounters a temperature change normally experienced at power on, or similar circumstances. The purpose of the invention is to keep the appearance of the display stable over a range of environmental conditions.

These and other objects and advantages of the present invention will no doubt become obvious to those of ordinary skill in the art after having read the following detailed description of the preferred embodiment, which is illustrated in the various drawing figures.

BRIEF DESCRIPTION OF THE DRAWINGS

FIG. 6A shows an embodiment of a lookup table (LUT) of this invention to illustrate the data on each page that is similar in form to the data shown on the Blue page.

DETAILED DESCRIPTION OF THE PREFERRED EMBODIMENT

Figure 1A:
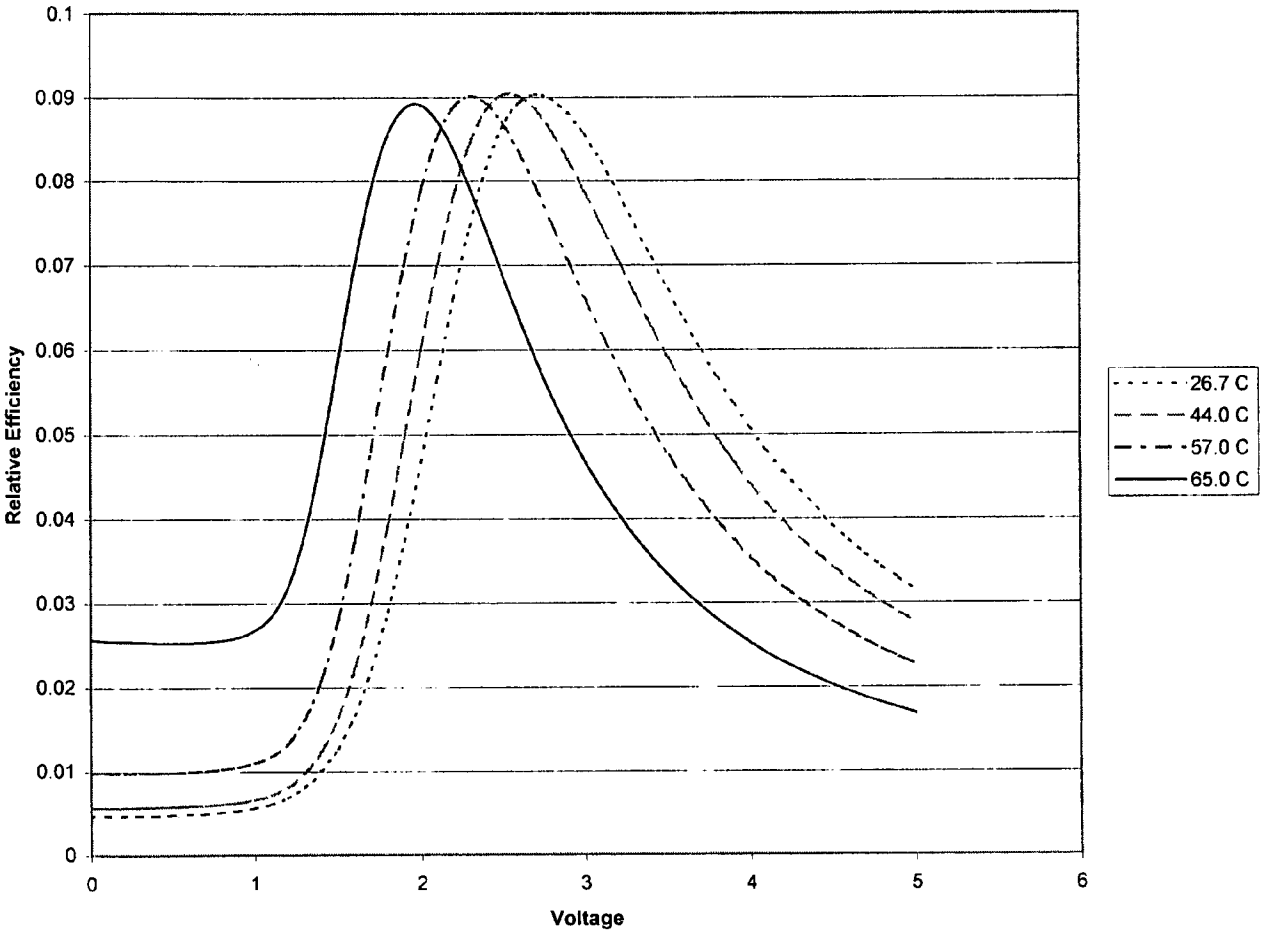
Fig. 1A (Prior Art)
FIG. 1A is a diagram for showing the variations of the electro-optic performance of nematic liquid crystal versus the variations of temperature.
Figure 1B:
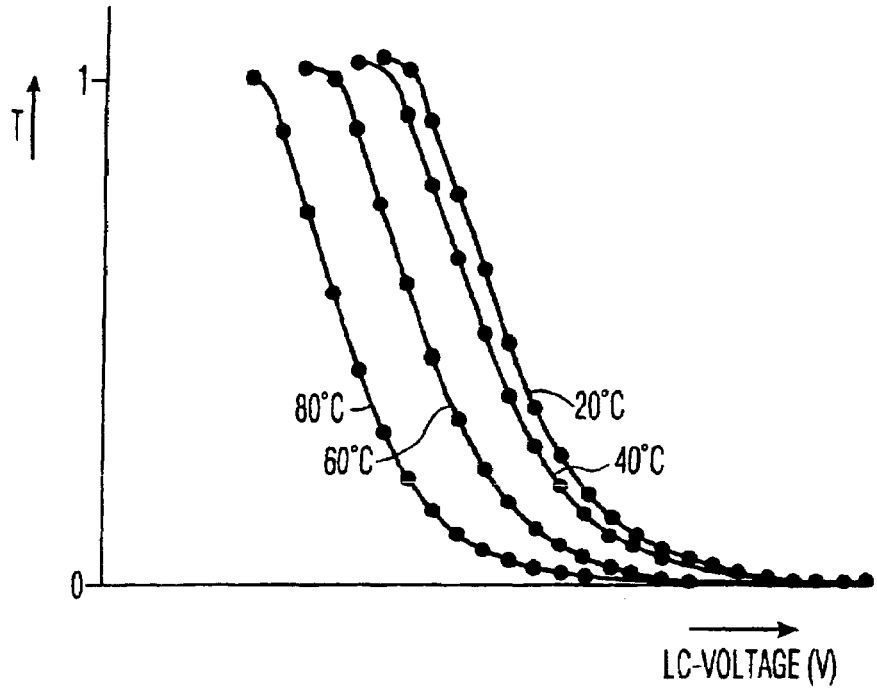
Fig. 1B (Prior Art)
FIGS. 1B and 1C are LC curves disclosed in a Prior Art Pat. No. RE 37,056 shown as a reference of this Application.
Figure 1C:
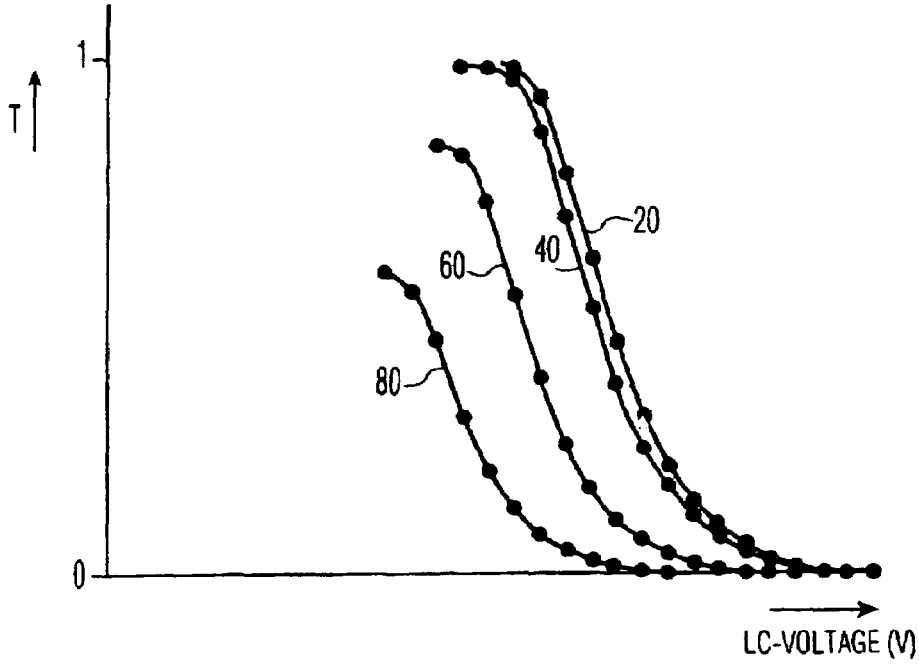
Fig. 1C (Prior Art)
Figure 1D:
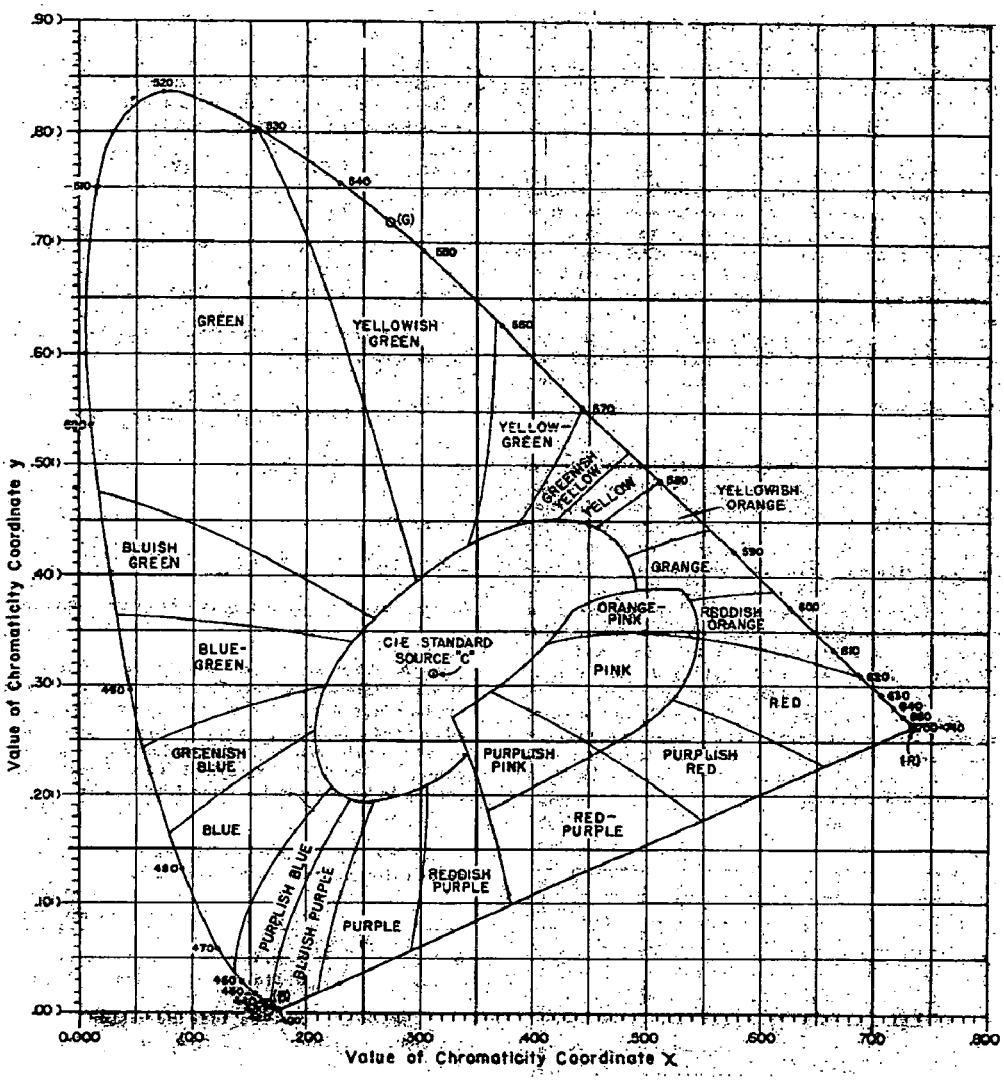
Fig. 1D (Prior Art)
FIG. 1D is a Chromaticity diagram based on non-physical XYZ parameters.
Figure 1E:
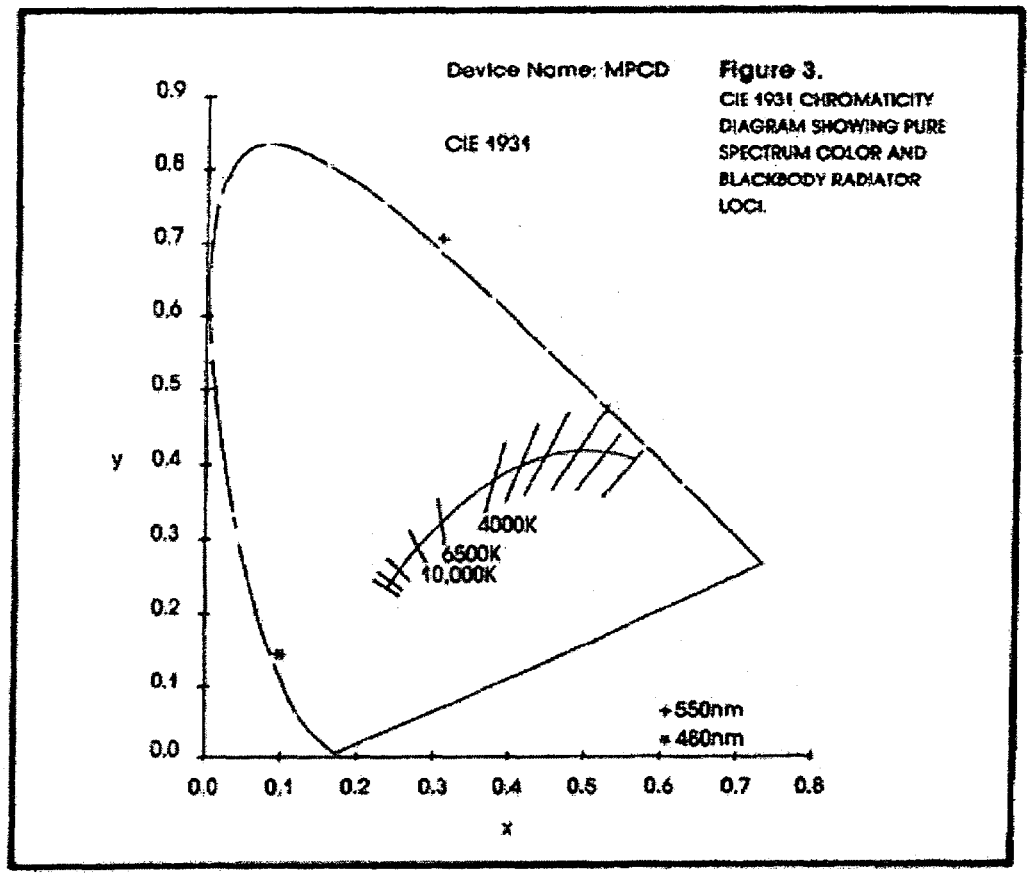
Fig. 1E (Prior Art)
FIG. 1E is another CIE Chromaticity diagram showing pure spectrum color and black body radiator LOCI.
Figure 1F:
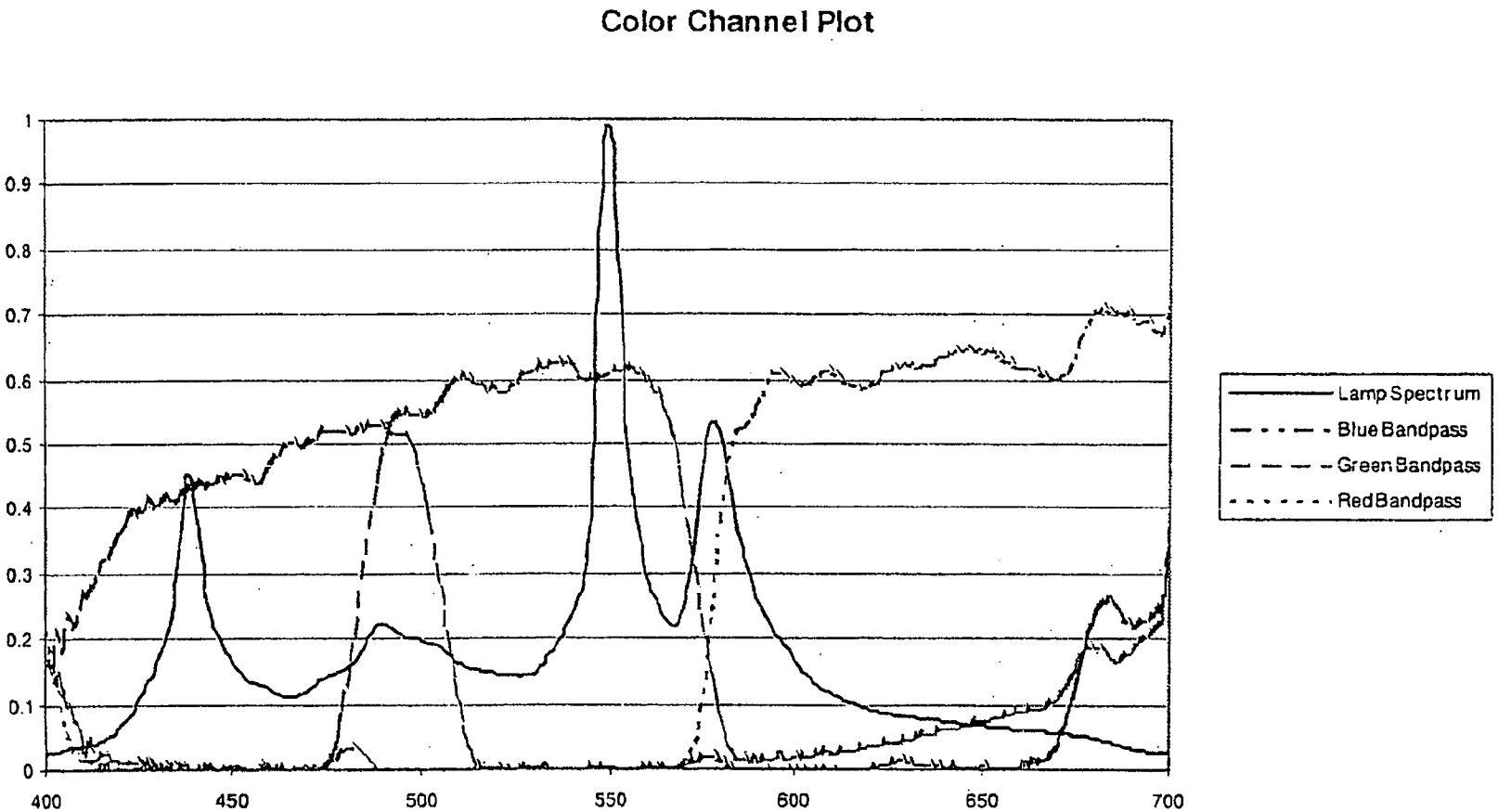
Fig. 1F (Prior Art)
FIG. 1F shows a spectral filtering arrangement showing a typical set of band pass limits for each color with efficiency superimposed on the normalized lamp spectrum.
Figure 2:
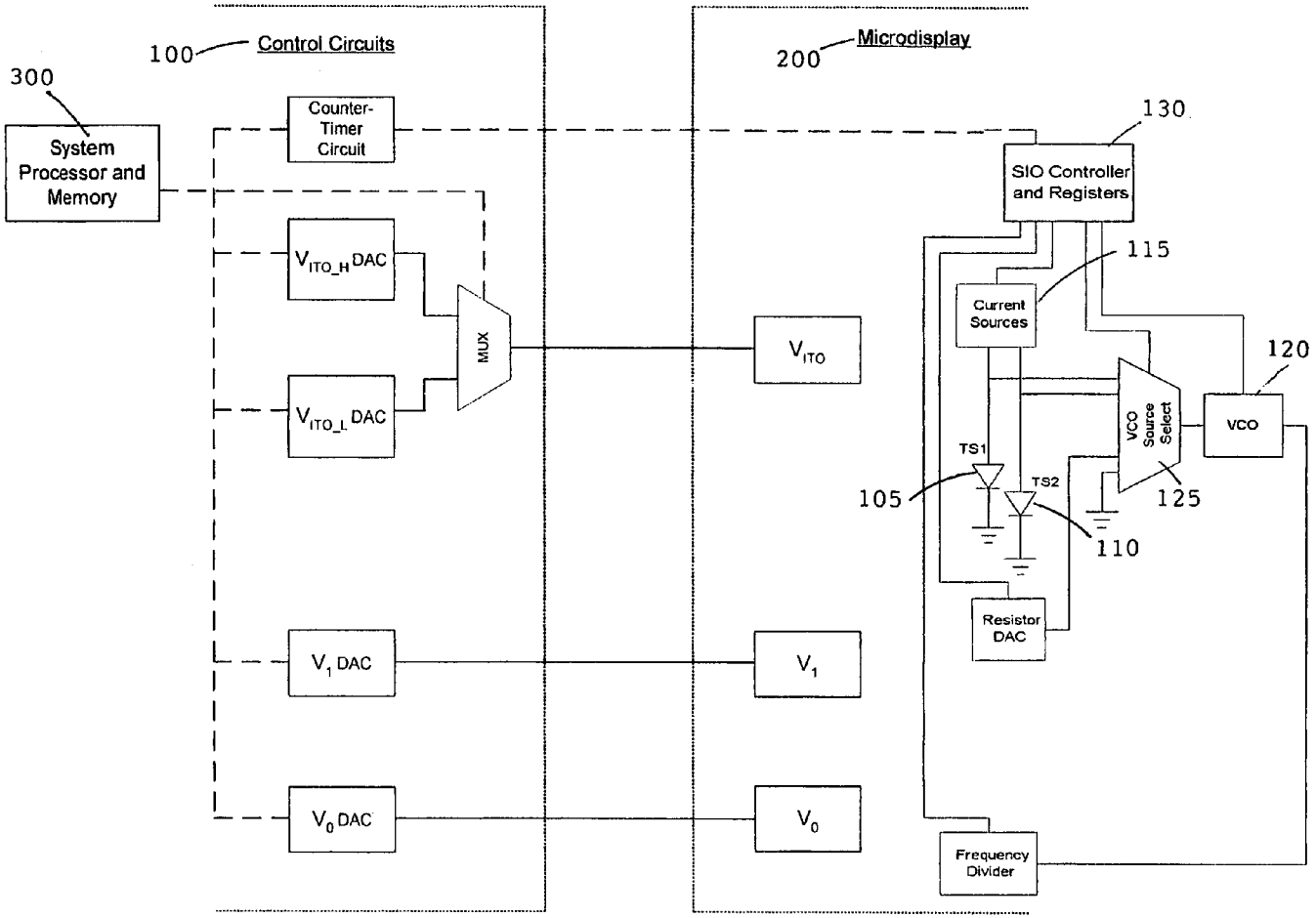
FIG. 2 is a functional block diagram for showing the interfaces between the microdisplay controller of this invention and the temperature sensor for controlling the microdisplay temperature.

Referring to FIG. 2 for the basic interfaces between the microdisplay controller 100 and the microdisplay device 200. The signals of temperature measurements are provided to the controller 100 from the temperature sensor shown as TS1 105 and TS2 110. In another co-pending patent application Ser. No. 10/627,230 submitted by a co-inventor of this Application, the details of the temperature measurement system are described. The patent application Ser. No. 10/627,230 is hereby incorporated as reference in this Application. In a preferred embodiment of the temperature sensing system as disclosed in the co-pending Application includes two diodes of two unequal current drains as shown as TS1 and TS2. The currents passed from the current source 115 through the two temperature sensing diodes TS1 105 and TS2 110 are applied to a voltage controlled oscillator VCO 120 via a VCO source selecting device 125 to generate an output signal as frequency that dependent on the temperature measurements. The temperature sensors are integrated into a backplane of a microdisplay system such that the sensors are disposed immediately next to the liquid crystal material where the temperature measurements and control are most crucial by controlling the temperature for improving the quality of image display.

For better understanding of this invention, another co-pending application Ser. No. 10/329,645 submitted by a co-inventor of this patent application is also incorporated herein as reference. The co-pending patent application Ser. 10/329,645 discloses a microdisplay controller and the microdisplay design that deliver voltages to the pixels based on a pulse width modulation scheme. Each pixel circuit has two voltage supplies deliverable to it, termed $V_0$ and $V_1$ that correspond to dark state and light state voltages. The voltages are relatively fixed and do not vary with data. A new data load modulates the display when this new data load overwrites the previous data load. The pixel switches to the other supply when the data on the pixel is changed. To DC balance the liquid crystal associated with the pixel electrode, a multiplex signal is sent to each pixel that switches a pixels voltage selection to the other supply and simultaneously switches the counter electrode to a new value that mains the symmetric nature of the liquid crystal drive voltage. The DC balancing of the display need not be accomplished synchronously with the switching of data. The modulation of the liquid crystal occurs because the pixels of the microdisplay switch between the two voltage supplies at a sufficiently rapid rate so as to appear as a voltage waveform. When this switching speed takes place at a very fast rate, the liquid crystal will appear to be responding to the RMS of the waveform. Thus switching between two voltages—one at or near the peak of the "white" region and the other at the "black" point, the liquid crystal will respond as if driven by a switching DC waveform at some intermediate point between the two voltages. The RMS voltage over the time scale of the liquid crystal reaction determines the exact point of reflectivity and that is the points to which the liquid crystal device is driven.

In the case of the normally black mode previously described, it is possible to present the curves in a different manner. Rather than display voltage versus throughput, the classic voltage-transfer curve, it is possible to plot a "digital drive-transfer" curve where the throughput is plotted as a function of the digital word that is used to create the drive voltage in the scheme under consideration. The digital word corresponds to a gray level in the drive scheme. Gray levels may range from 2 (full on or full off) to as many as are practical. In modern color display systems gray levels may vary from 6 bits per color in some inexpensive flat panel displays to as high as 12 or 14 bits per color (36 to 42 bits) in some very expensive high end displays.

Referring to FIG. 2 again, for a particular configuration that the microdisplay controller 200 function as an interface to the system microprocessor 300. The temperature is measured onboard the silicon die of a microdisplay and the temperature sensing circuit 120 converts the temperature into square waves representing a frequency or period signal. The signals are transmitted over the interconnections; typically parallel flex cable for inputting to microdisplay controller 200 by first converting through a counter timer circuit 130 to a digital word. The digital word is then posted on the Control Register 130 where the microprocessor 300 can poll and readout the frequency data corresponding to a temperature measurement signal. The Microprocessor 300 takes the data presented and performs several analyses upon it. The microprocessor 300 can first assess the data for reasonability based on previous data. If the data is reasonable it then calculate the new $V_0$ and $V_1$ for the display based on interpolation within a lookup table characterizing the $V_0$ and $V_1$ at specific temperatures for the microdisplay. In FIG. 2 the solid lines represent a physical electric connection and the dashed lines represent flow of control signals and data. All lines form the system processor and memory is logic control lines.

The output of the temperature sensor transmitted back to the counter-timer circuit 140 contains data available for to be further processed by the system processor 300. The counter time circuit 140 on the Control Circuits 100 is optional in that it is needed for circuits of a specific implementation. Alternatively, if the temperature sensor output were an analog voltage then the device could be replaced by an Analog to Digital converter (ADC). If the output were digital, then the block could be dispensed with and the output could be fed directly to the System Processor and Memory. The System Processor and Memory 300 loads digital words into the $V_{ITO_H}$ DAC and $V_{ITO_L}$ DAC that correspond to voltages that the DACs are to generate. The outputs of these DACs are fed into a multiplexer MUX that selects which DAC voltage is to be used to drive the ITO voltage ($V_{ITO}$). The DACs are preferentially Resistor DACs because RDACs have superior accuracy after calibration. Alternatively they can be laser-trimmed DACs of any sort. The DAC voltage may pass through OpAmps (not depicted) to scale their voltages if the required voltage is not within the direct voltage range of the DAC. Furthermore, the System Processor Memory 300 loads digital words into the $V_1$ DAC and $V_0$ DAC that correspond to voltages that the DACs are to generate. The outputs are fed directly into the microdisplay ports for $V_0$ and $V_1$. The DACs are preferentially Resistor DACs because RDACs have superior accuracy after calibration. Alternatively they can be laser-trimmed DACs of any sort. The DAC voltage may pass through OpAmps (not depicted) to scale their voltages if the required voltage is not within the direct voltage range of the DAC.

Figure 3A:
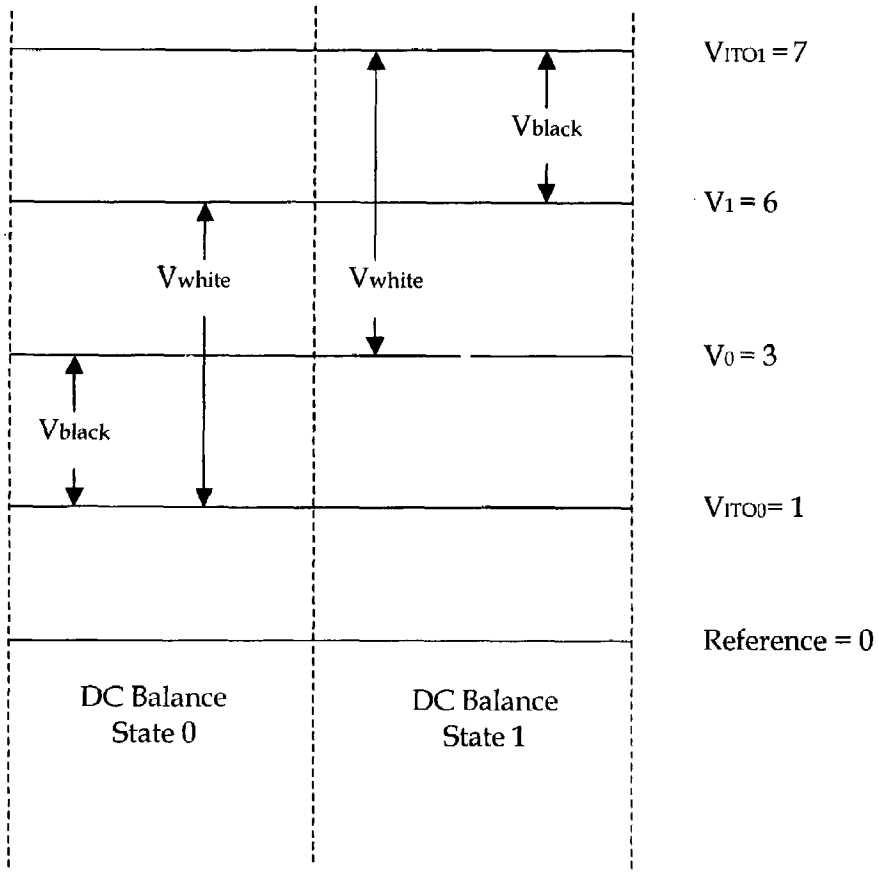
FIGS. 3A and 3B show the reference voltage level for DC balancing of a liquid crystal display system and the variation of drive voltage due to temperature changes.
Figure 3B:
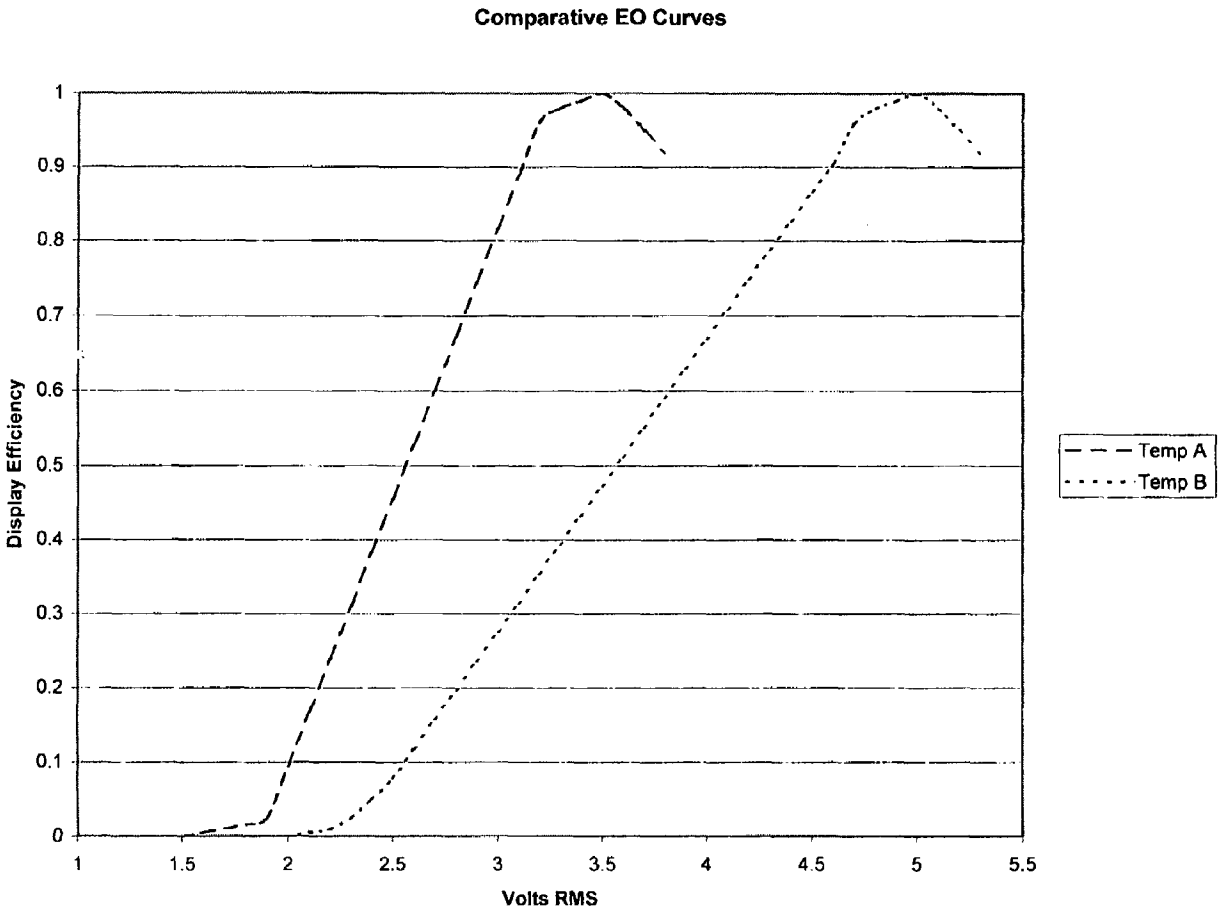
Figure 3C:
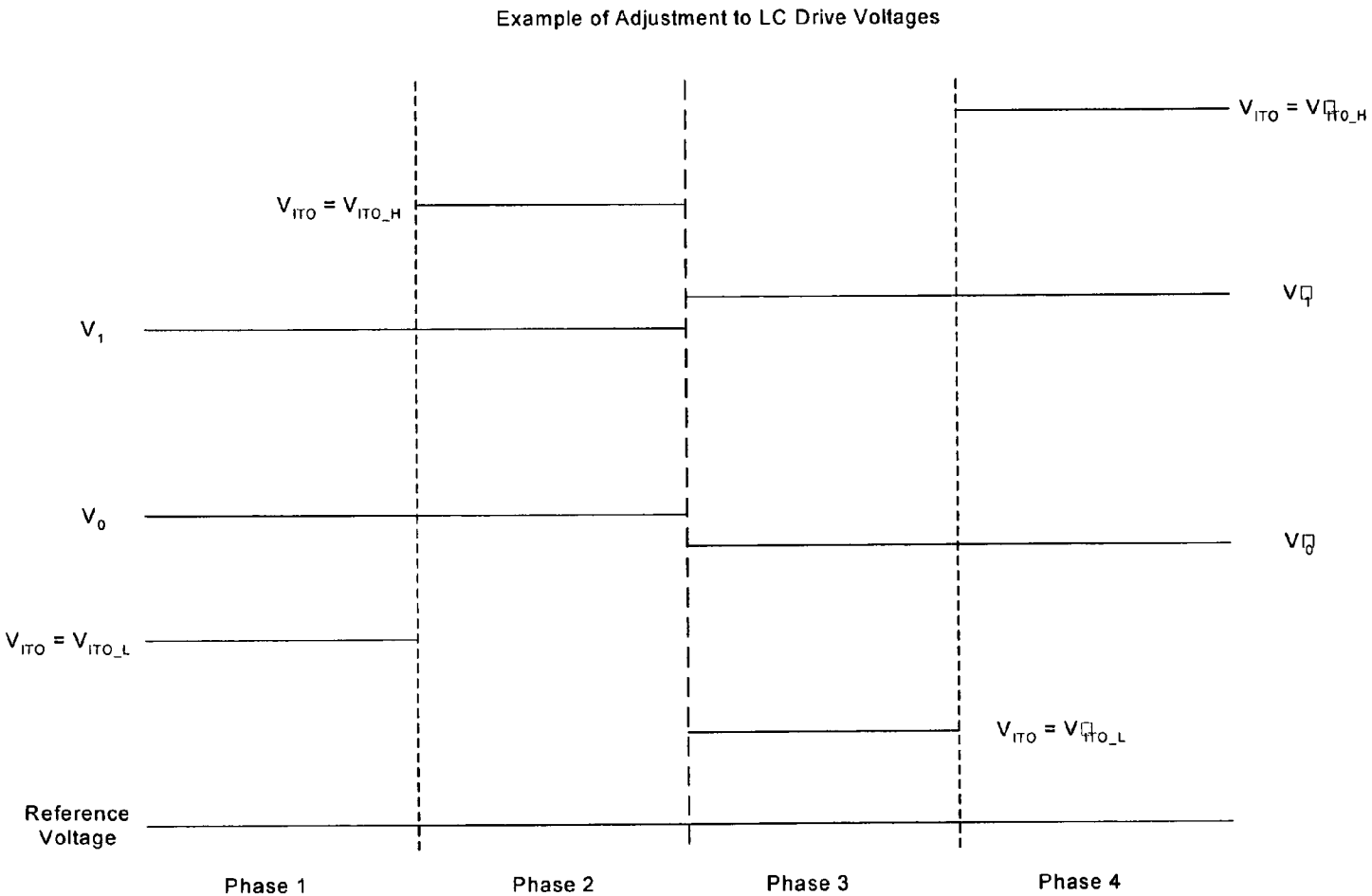
FIG. 3C is diagram showing an example of voltage level changes at different phase of operation of a microdisplay having different temperatures.

There is a normal relationship between the various voltages referenced as that shown in FIG. 3A. The absolute magnitude of the difference between $V_0$ and $V_{ITO_L}$ is equal to the absolute magnitude of the difference between $V_1$ and $V_{ITO_H}$. The relationship of the various voltages insures that the liquid crystal cell remains accurately DC balanced during operation. With the relationship between different voltages as shown, the control system of the present invention for the microdisplay makes use of measured temperatures to adjust the voltage operating parameters to optimize performance of the liquid crystal device. Referring to FIG. 3B as an example that illustrates the electro-optical (EO) curve changes with temperature. One represents the electro-optic curve for Temperature A where the curve is steep and the difference between the white state voltage and the dark state voltage is around 2.0 volts. The other represents the electro-optic curve for Temperature B where the curve is less steep and the difference between the white state voltage and the dark state voltage is around 3.0 volts. The voltage shift as shown is probably unusual and is provided for illustrating the fact that as the temperature changes the optimal drive voltages will also change. The present invention provides control mechanism to effectively respond to such variations. As the results of variations of drive voltages at different temperatures, the system processor 300 can carry out selection of optimal voltages in different ways. The microprocessor takes into consideration the fact that the modification of voltage operating point in response to changes in temperature is likely to take place relatively slowly—on the time scale of seconds rather than milliseconds. Each microdisplay has a different thermal environment. Blue, for example, normally runs hotter because blue light has more energy than green or red. Also mounting considerations may make one microdisplay hotter than others because of proximity to the lamp and such configuration, although a poor one when considering the temperature effects is nevertheless a common design practice among many of the microdisplay systems. Therefore each microdisplay should be managed separately. Special data can be loaded into the database of the microprocessor 300 to provide microdisplay dependent control base on special operational characteristics of the microdisplay. The data for each microdisplay system can be collected and then stored in a lookup table for later use. The use of interpolation within the lookup table to resolve to more optimal solutions may be required. As the voltages are modified, it is essential that the relationship between voltages described above be maintained to maintain DC balance of the liquid crystal cell. This requires some form of calibration, as previously mentioned. The system processor can be programmed to carry out different calibration operations and data interpolations to determine the optimal voltages at a different temperature as that shown in FIG. 3C to achieve optimal image display quality when temperature variations occur.

Figure 4:
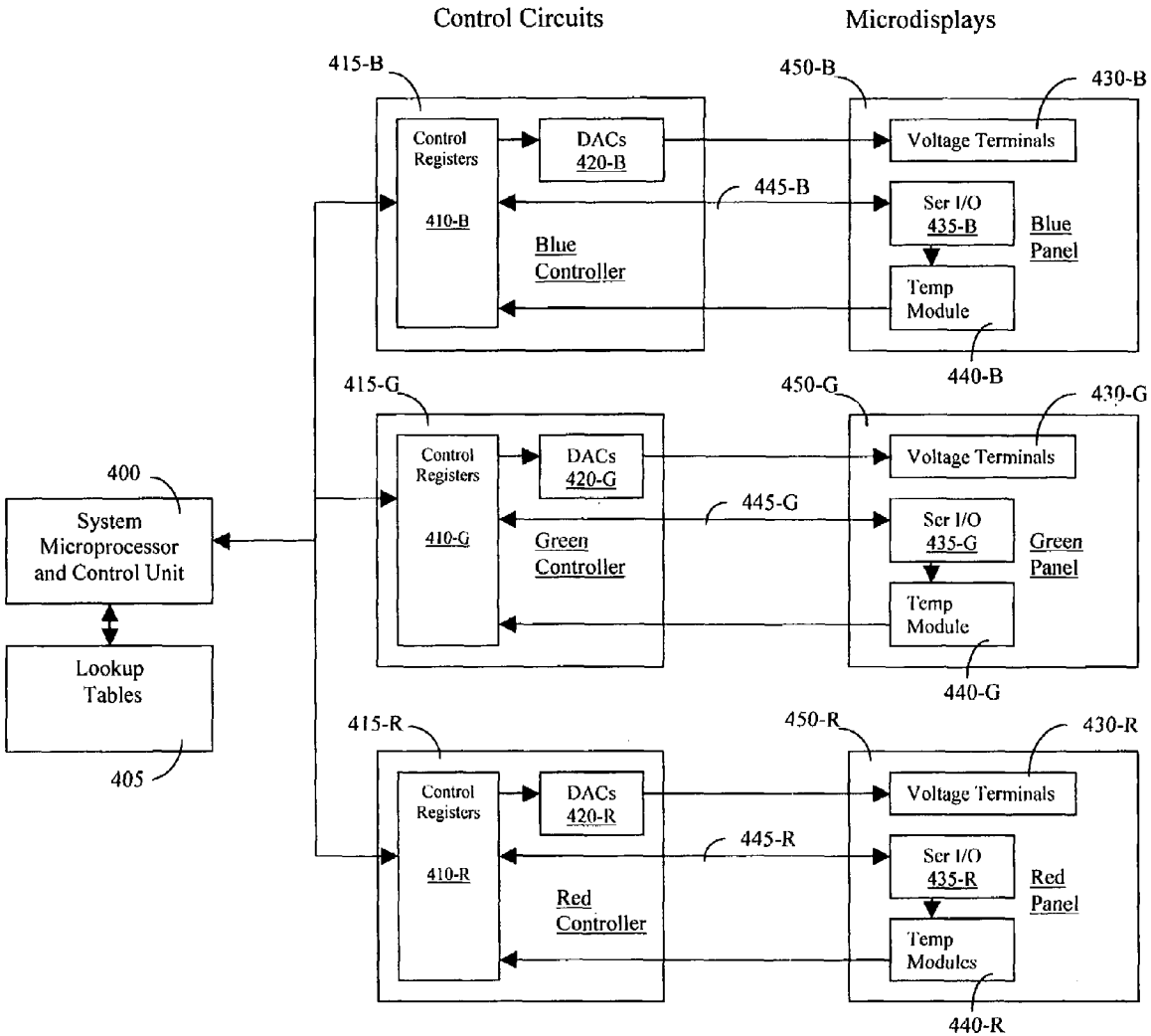
FIG. 4 shows functional blocks to realize the temperature compensation and control for each color channel of the present invention.

FIG. 4 shows a closely coupled electrical architecture of the present invention that applies the measured microdisplay temperature, one for each color channel, together with lookup tables preloaded with measured or predicted data for a display, to modify the liquid crystal voltage operating range of each microdisplay as required to achieve and maintain the proper white point operating point for the display. The electrical architecture as shown includes functional blocks as required for realizing the temperature compensation and control for each color channel of the present invention. The system microprocessor and control unit 400 employs a lookup table 405 to set the control registers 410-R, 410-G and 410-B on each microdisplay controller with values according to a computed value using the data retrieved from the lookup tables 405. The range of values in the lookup table 405 includes setups for a number of varied conditions. One of these conditions is temperature. The detailed function here will be explained in a succeeding paragraph.

One function of the system microprocessor 400 is to set the voltages that drive the microdisplays. The digital words to command the different voltages are loaded into the Control Registers on the controllers, one for each channel to control the microdisplay. The correct loads for each color channel are then transferred to each of the DACs 420-R, 420-G and 420-B. The DACs values are inputted to the corresponding voltage terminals 430-R, 430-G and 430-B respectively to set the voltages, which are then scaled to operating voltage by a set of Op-Amps. This establishes the voltages for Vwhite and Vblack as well as the two Vito voltages. In the descriptions of this invention, for reasons for clarity, the term Vwhite, Vblack and Vito may be used interchangeably with the terms V0, V1, Vito_0 and Vito_1. The exact relationship for a normally black mode can be better understood according to following tables:

| DC Balance State | 0 | 1 |
|---|---|---|
| Vwhite | V1 | V0 |
| Vblack | V0 | V1 |
| Vito | Vito_0 | Vito_1 |

The exact relationship for a normally white mode is as follows:

| DC Balance State | 0 | 1 |
|---|---|---|
| Vwhite | V0 | V1 |
| Vblack | V1 | V0 |
| Vito | Vito_0 | Vito_1 |

Another function of the microprocessor is to control the operation of the temperature sensor system and interpret the temperature readings measured by the temperature sensor modules 440-R, 440-G, 440-B from the individual microdisplay panels 450-R, 450-G, and 450-B respectively. The microprocessor 400 sets the digital word on the Control Registers on each Microdisplay Controller 415-R, 415-G, and 415-B. The Microdisplay Controller in turn passes the control signals to the Microdisplay via the Serial Input/Output line 445-R, 445-G, and 445-B to and from the set I/O registers 435-R, 435-B, and 435-B in each color panel 450-R, 450-B, and 450-B respectively. The Temperature Module function is in turn set from the Serial I/O registers 435-R, 435-B, and 435-B. The output of the Temperature Module is passed back to the Microdisplay Controller, which in turn passes the data back to the System Microprocessor and Control Unit. Alternatively a state machine within the Microdisplay Controller 415-R, 415-B, and 415-G can preprocess the information received from the Microdisplay Temperature Modules 440-R, 440-G, and 440B. The allocation of functions among the various components is not so important as the accomplishment of the function.

The process used to assess the state of the system and then make the necessary adjustments requires first of all that the system temperatures be measured and assessed. The assessment of temperature may include reasonability assessments to be certain that the data is anomalous. It may also include data smoothing measures such as averaging or Kalman filtering. The present invention assumes that the data is assessed to be reasonable or that the temperature sensor is known to be otherwise trustworthy by excellence of design or proven reliability.

Figure 5:
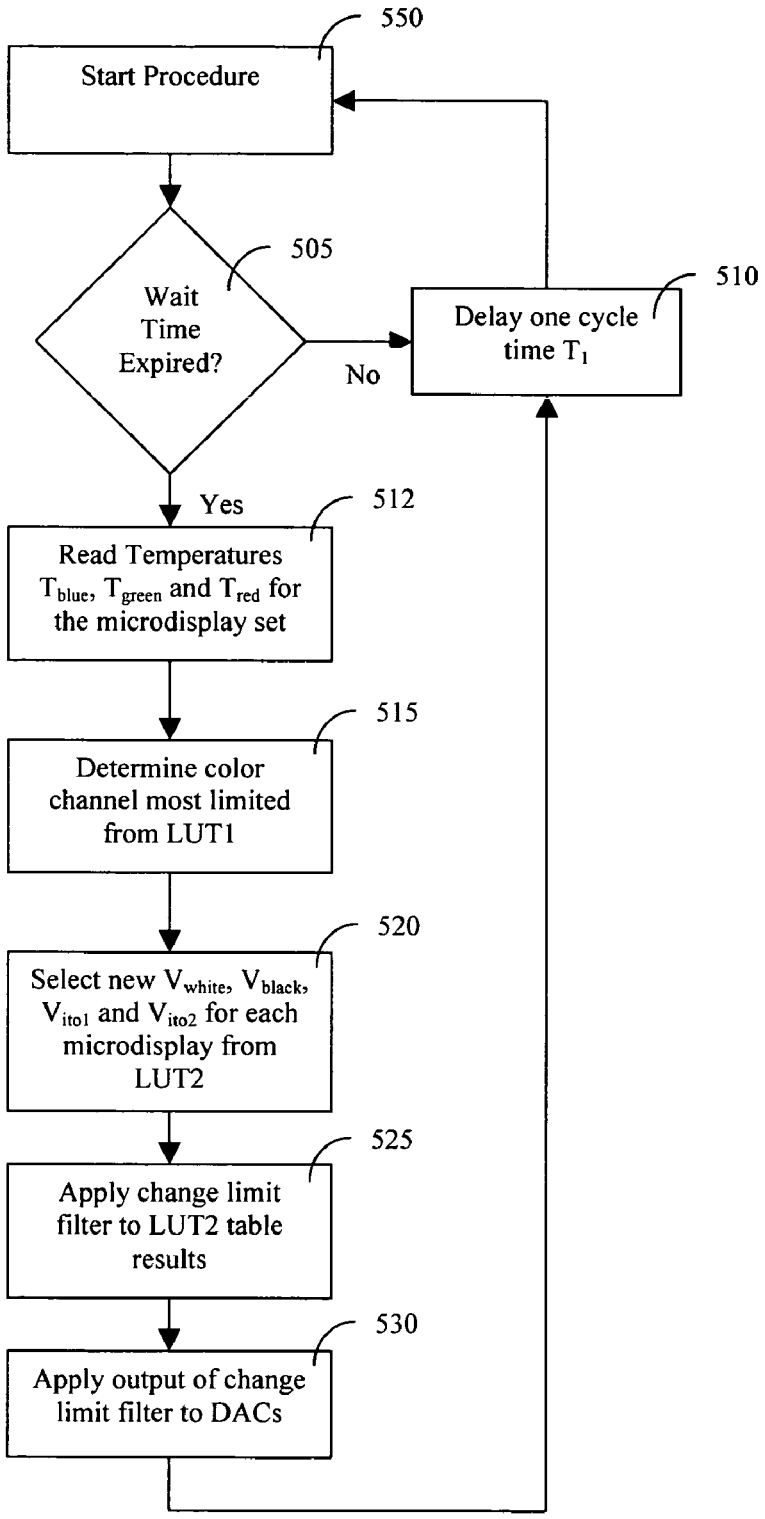
FIG. 5 is a flowchart for showing the temperature-based adjustment processes for a microdisplay system of this invention.

Referring to FIG. 5 for the temperature-based adjustment processes for a microdisplay system of this invention. The processes starts (step 500) with a first step in the temperature-based adjustment process is to look at the clock time (step 505) since the last adjustment and compare it to the predetermined wait time. A programmable wait time is provided to insure that the changes are not made too rapidly. Normally temperature changes take place on a relatively slow time scale. The time scale may be tenths of a second, or seconds, or tens of seconds, depending on the particulars of the system design. If the wait time has expired, then the procedure progresses through the remainder of the processes; otherwise, it loops back and waits another cycle (step 510).

Once the wait loop time has expired, the full assessment process begins. As previously stated, the temperature assessment systems for each microdisplay provide measured temperature data from the microdisplay sensors for use by the system (step 512). This may be one of the integral temperature sensors previously discussed, or alternatively a PID device or thermocouple or some other sensor known in the art.

The next step is to take the received temperature information and determine from that information which color channel is most limited in the sense that the maximum efficiency of that channel at its operating temperature limits its maximum contribution to achieve the required color balance less than what the other color channels are capable of (step 515). The data for the color channels versus temperature may be stored in a lookup table LUT1, or alternatively it may be stored in a series of lookup tables. While it is possible that a mathematical description might be found using curve fit processes, this hardly seems necessary.

The structure of LUT1 is of interest. LUT1 may be divided into three pages, each page corresponding to a color channel in the device. The entry index for the pages in the table is a temperature. The temperature may be stored at reasonable intervals, such as 1° C. or 5° C., or even at variable intervals. The resulting value may be the result of interpolation between two values following a linear or other rule. This value is a maximum relative efficiency value. The maximum relative efficiency value is an arbitrary constructed value that may be based on the best efficiency at the design point (color temperature) of the system in which the displays are operated, or on some other point of operation. These may not reflect the peak intensity of the system but rather the efficiencies at the desired color point. More than one set of tables may be needed if the system is further designed to support more than one color temperature set point, as is often the case with CRT and LCD monitors commonly available as of this writing.

Referring to FIG. 6A for an embodiment of a LUT1 table of this invention. The data on each page is similar in form to the data shown on the Blue page. Again the efficiency data is normalized relative to a contribution level established at nominal operating conditions in a color-balanced system. The function of this lookup table is to permit identification of the limiting color channel and its associated efficiency. The efficiency number will be lower than the peak efficiency associated with the other channels at their respective temperatures.

Figure 6B:
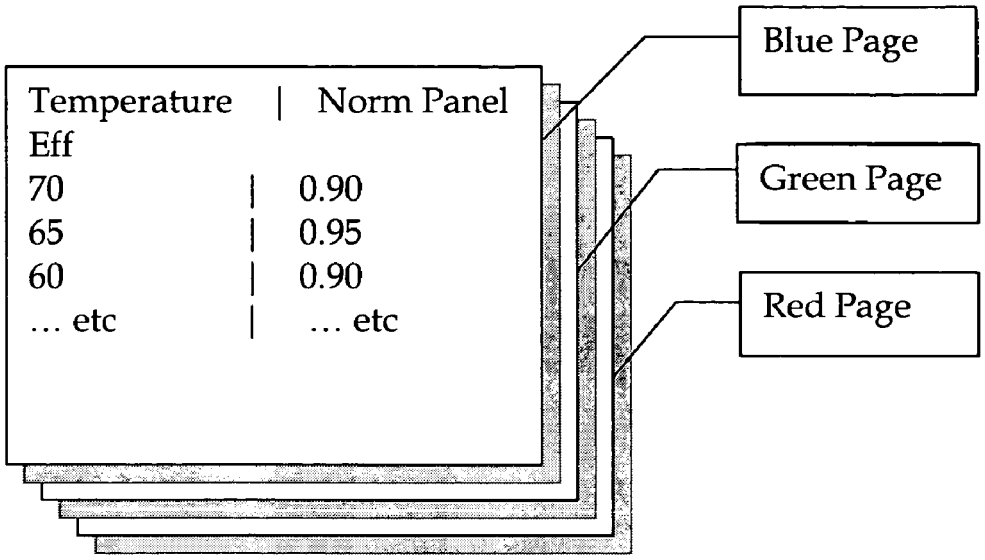
FIG. 6B illustrates the LUT table illustrated as a page for each color.

An illustration of one form of the second lookup table (LUT2) follows the Table LUT1 is shown in FIG. 6B that depicts a separate page for each color. In the example, two indicia are used to recover the output of the table. The first index is the panel temperature for the panel. The second index is the normalized panel efficiency recovered from LUT1 (step 520). By using these two entries it is possible to recover the $V_{WHITE}$ and $V_{BLACK}$ drive setting (step 525) needed to set up the DACs to drive the device with the voltages required to maintain the correct color balance and $V_{ITO1}$ and $V_{ITO2}$ needed to keep the symmetrical drive needed for DC balancing (step 530). With this data derived for each panel, the system can then be operated with a consistent color balance with less concern for the impact of changing environmental conditions upon display performance.

Entries for both LUT1 and LUT2 are both best determined experimentally, although once a system is characterized, knowledge of color science and an understanding of the E-O curves for a particular set of microdisplays can permit extension of the data into regions beyond the scope of the data. The predictive arts may be applied subject to an assessment of the deviation of the particular system under inquiry from the statistical mean.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

We claim:

1. A liquid crystal display (LCD) system implemented with a thermal control and management system comprising:

a temperature sensor system disposed directly on a backplane of a silicon die of a LCD microdisplay device immediately next to a liquid crystal material for directly measuring a temperature of said microdisplay device and generating a temperature measurement signal;

a microdisplay controller for controlling voltages of said microdisplay device and receiving said temperature signal for transmitting a digital signal to a system processor; and said system processor having a color-specific-thermal-effect voltage database for receiving and processing said temperature measurement signal by employing said color-specific thermal-effect voltage database to generate color specific temperature-dependent reference voltages to apply as switchable DC-balancing reference voltages to a common electrode connected to a plurality of pixel cells for operating said microdisplay system by accounting for a thermal-effect of color balance whereby said color specific temperature dependent reference voltages are most suitable for said temperature measurement signal and also for said DC-balancing reference voltages.

2. The LCD system of claim 1 wherein:

said system processor further generating a color-specific temperature-dependent black state voltage and a white state voltage as said switchable DC-balancing black state and white state voltages applied to a common electrode connected to a plurality of pixel cells for each color most suitable for said temperature measurement signal accounted for said thermal-effect of color balance.

3. The LCD system of claim 1 wherein:

said microdisplay controller further includes control register for loading and reading said temperature measurement signal as a digital word.

4. The LCD system of claim 1 wherein:

said microdisplay controller further includes color-specific digital-to-analog converter (DAC) output circuits for outputting said color-specific temperature dependent reference voltages to apply as switchable color-specific DC-balancing reference voltages.

5. The LCD system of claim 4 wherein:

said DAC further comprising a resistor digital to analog converter (RDAC).

6. The LCD system of claim 1 wherein:

said system processor further interpolating between two data in said color-specific-thermal-effect voltage database for generating said color-specific temperature dependent reference voltages to apply as switchable color-specific DC-balancing reference voltages.

7. The LCD system of claim 1 wherein:

said temperature sensor system further integrated as an integrated circuit chip disposed directly on a backplane of said silicon die of said LCD microdisplay device.

8. The LCD system of claim 1 wherein:

said temperature sensor system further comprising a PTAT temperature senor system and integrated as an IC chip disposed directly on a backplane of said silicon die of said LCD microdisplay device.

9. The LCD system of claim 1 wherein:

said system processor further includes an additional cooling activating system to activate additional cooling for said LCD microdisplay device in response to said temperature measurement signal.

10. The LCD system of claim 1 wherein:

said system processor further determining if said temperature measurement signal is within a predefined range.

11. The LCD system of claim 1 wherein:

said system processor further receiving and processing said temperature measurement signal to function as a part of a Peltier thermal control loop.

12. The LCD system of claim 1 wherein:

said microdisplay controller generating said color-specific temperature-dependent reference voltages to apply as said switchable DC-balancing reference voltages most suitable for said temperature measurement signal for operating said microdisplay system as a liquid crystal display (LCD) device of a normally white mode accounted for said thermal-effect of color balance.

13. The LCD system of claim 1 wherein:

said microdisplay controller generating said color-specific temperature-dependent reference voltages to apply as said switchable DC-balancing reference voltages most suitable for said temperature measurement signal for operating said microdisplay system as a liquid crystal display (LCD) device of a normally black mode accounted for said thermal-effect of color balance.

14. A liquid crystal display (LCD) system comprising:

a thermal control and management system having a color-specific-thermal-effect voltage database for receiving and processing a microdisplay temperature measurement signal for said microdisplay system by employing said color-specific-thermal-effect voltage database to generate color specific temperature-dependent reference voltages to apply as switchable color-specific DC-balancing voltages for inputting to a multiplexer of a microdisplay controller for controlling a high and a low voltages for a common electrode connected to a plurality of pixel cells of said LCD system switchable for a DC balancing of said LCD display system.

15. The liquid crystal display (LCD) system of claim 14 further comprising:

a system processor for generating a color-specific temperature-dependent black state voltage and a white state voltage as switchable color-specific DC-balancing black state and white state voltages for operating said microdisplay system most suitable for said temperature measurement signal accounted for said thermal effect of color balance.

16. The liquid crystal display (LCD) system of claim 15 further comprising:

a microdisplay controller having a control register for loading and reading said temperature measurement signal.

17. The liquid crystal display (LCD) system of claim 15 wherein:

said system processor further includes DAC output circuits for outputting said temperature dependent reference voltages.

18. The liquid crystal display (LCD) system of claim 15 wherein:

said system processor further interpolating between two data in said database for generating said temperature dependent reference voltages.

19. The liquid crystal display (LCD) system of claim 14 wherein:

said thermal management and control system further includes a temperature sensor system integrated as an integrated circuit chip disposed directly on a backplane of a silicon die of a LCD microdisplay device immediately next to a liquid crystal material in said LCD system.

20. A method for temperature control and compensation for a microdisplay system comprising:

receiving and processing a microdisplay temperature measurement signal from said microdisplay system by employing a color-specific-thermal-effect voltage database to generate color specific temperature-dependent reference voltages; and applying said color-specific temperature-dependent reference voltage to a multiplexer as switchable color-specific DC-balancing reference voltages for controlling voltages for a common electrode connected to a plurality of pixel cells of said LCD system of said microdisplay system in response to said temperature measurement signal whereby a thermal-effect of color balance is accounted for by said thermal control and management system.

21. The method of claim 20 further comprising:

said step of generating said color specific temperature-dependent reference voltages further comprising a step of multiplexing and generating a color specific temperature-dependent black state voltage and a white state voltage to apply as said switchable color-specific DC-balancing reference voltages to said common electrode connected to said plurality of pixel cells of said LCD system for operating said microdisplay system most suitable for said temperature measurement signal accounted for said thermal effect of color balance.

22. The method of claim 20 wherein:

said step of receiving and processing said temperature measurement signal from said microdisplay system further includes a step of receiving said temperature measurement signal into a system processor having a control register for loading and reading said temperature measurement signal.

23. The method of claim 20 wherein:

said step of generating said color-specific temperature-dependent reference voltages for operating said microdisplay system further comprising a step of outputting said color specific temperature-dependent reference voltages through DAC output circuits.

24. The method of claim 20 wherein:

said step employing said color-specific-thermal-effect voltage database for generating said color specific temperature-dependent reference voltages further comprising a step of interpolating between two data in said color-specific-thermal-effect voltage database for generating said switchable color-specific DC-balancing reference voltages.

25. The method of claim 20 further comprising:

integrating a temperature sensor system as an IC chip disposed directly on a backplane of a silicon die immediately next to a liquid crystal material of said microdisplay system.

26. The method of claim 20 wherein:

said step employing said color-specific-thermal-effect voltage database for generating said color specific temperature-dependent reference voltages further comprising a step of applying a curve-fitting algorithm using data in said color-specific-thermal-effect voltage database for generating said switchable color-specific DC-balancing reference voltages to said common electrode connected to said plurality of pixel cells of said LCD system.

27. A method for controlling and compensating temperature effects of a microdisplay system comprising:

measuring a microdisplay temperature, one for each color channel; and preloading lookup tables having measured/predicted data for a display, to modify a liquid crystal voltage operating range by generating and applying, for each temperature measurement two switchable color-specific DC-balancing voltages to a common electrode connected to a plurality of pixel cells of said LCD system of said microdisplay for each color as required to achieve and maintain a proper white point operating point for said microdisplay.

* * * * *